US005471024A

United States Patent [19]

Ross et al.

[11] Patent Number: 5,471,024

[45] Date of Patent: Nov. 28, 1995

[54] ELECTRIC SWITCH HAVING IMPROVED ATTACHMENT OF MOVABLE CONTACT TO CONTACT CARRIER

[75] Inventors: Michael E. Ross, Clayton; Robert A. Borsos; Lawrence G. Corey, both of Smithfield, N.C.

[73] Assignee: Eaton Corporation, Cleveland, Ohio

[21] Appl. No.: 304,291

[22] Filed: Sep. 12, 1994

[51] Int. Cl.[6] ..... H01H 5/10

[52] U.S. Cl. ..... 200/458; 200/453; 200/275; 200/454

[58] Field of Search ..... 200/458, 453, 200/454, 275, 553, 554, 555, 556, 557, 558, 560, 561, 562, 563

[56] References Cited

U.S. PATENT DOCUMENTS

| | | | |
|---|---|---|---|
| 3,052,865 | 9/1962 | Pappano et al. | 339/126 |
| 3,158,418 | 11/1964 | Rush | 339/17 |
| 3,828,148 | 8/1974 | Roeser | 200/6 A |
| 4,196,325 | 4/1980 | Povilaitis | 200/67 A |
| 4,904,832 | 2/1990 | Nagahara et al. | 200/453 |
| 5,017,747 | 5/1991 | Nagahara et al. | 200/453 |

*Primary Examiner*—Henry J. Recla
*Assistant Examiner*—David J. Walczak
*Attorney, Agent, or Firm*—Larry G. Vande Zande

[57] ABSTRACT

A flexible movable contact having fulcrums for pivoting the contact within notches of a terminal has a tab between the fulcrums offset downwardly and projecting outwardly that extends through an aperture in a flat U-shaped insulating contact carrier to attach one end of the contact to the carrier. A right-angle flat transition surface between the offset tab and primary plane of the contact abuts a convex surface forming an edge of the aperture to permit the contact to pivot relative to the carrier for self-alignment of the fulcrums in the notches. A beam of the contact extends obliquely away from the carrier and has lateral arms terminating in hook portions engaging an opposite side of the carrier. Ears bent over on the free end of the contact beam arrest overtravel movement of the carrier, which movement can be closely controlled by tolerances between the ears and hook portions during manufacture of the movable contact.

19 Claims, 3 Drawing Sheets

ELECTRIC SWITCH HAVING IMPROVED ATTACHMENT OF MOVABLE CONTACT TO CONTACT CARRIER

BACKGROUND OF THE INVENTION

This invention relates to electric switches and more particularly to bistable, snap action electric switches. Still more particularly, the invention relates to electric switches of the aforementioned type commonly known as sump pump switches which control the starting and stopping of electric motors which operate pumps in response to the rise and fall of the level of water or other liquid.

A particular sump pump switch is shown in U.S. Pat. No. 4,196,325 issued Apr. 1, 1980 to S. A. Povilaitis and assigned by mesne assignments, to the assignee of this application. The disclosure of U.S. Pat. No. 4,196,325 is hereby incorporated by reference into this application. Disclosed in that patent is a two-pole overcenter snap action switch having a lever operator pivotally mounted in the housing and connected to a pivotally mounted U-shaped movable insulating contact carrier by a compression spring. The movable contacts for each pole are mounted on a common movable insulating contact carrier for simultaneous closing or opening with the stationary contacts of the two poles. To this end, it is important that the movable contacts be mounted to the movable insulating contact carrier for pivotal motion relative thereto in the general plane of the contact carrier to permit self-alignment of the movable contacts to the terminal members on which the movable contacts pivot. Previous methods for attaching the movable contacts to the contact carrier in a manner that would provide the self-alignment pivoting feature have proven costly and not entirely effective. In the aforementioned patent, the movable contacts are loosely attached to the U-shaped insulating movable contact carrier by rivets. When properly riveted, the movable contact is able to pivot about the rivet in the general plane of the contact carrier or the primary plane of the movable contact. However, it is difficult to maintain a consistent degree of looseness of a riveted connection from one contact to another. Riveting also represents an additional step in the manufacturing process.

A more recent commercial offering of the sump pump switch described above has provided clip-on movable contacts as shown in FIGS. 2 and 3 of the drawings. A U-shaped clip 42 is provided at one end of the movable contact 40 for mounting the contact to a movable insulating contact carrier 44. The insulating contact carrier is U-shaped and provided with a round hole 46 near the distal end of each of the outer legs. The contact 40 is provided with a semi-circular tab 48 which is sheared into the contact to mate with the round hole 46. Precise and consistent forming of the spring clip 42 is difficult to maintain. Moreover, semicircular tab 48 is preferably angularly offset to automatically snap into round hole 46 in the contact carrier 44 upon assembly. However, the relative short length of the tab compared to the length of the U-shaped clip renders the tab substantially more rigid than the clip. When inserting the contact carrier 44 into the spring clip 42, the tab 48 raises the contact carrier as it is inserted, causing the carrier 44 to rise up on the tab 48 and deflect the U-shaped clip 42 more widely open. Depending on the amount of deflection, the spring clip 42 can be unacceptably deformed. If the tab 48 is formed low enough not to cause deformation of the spring clip 42 upon assembly, it then provides insufficient engagement with the contact carrier 44 to retain the movable contact 40 on the carrier. This problem was resolved by an additional operation whereby the tab 48 was sheared into the contact 40, but not angularly offset upon fabrication of the movable contact and was subsequently deflected into the round hole 48 by an additional staking operation to increase the reliability of the engagement of the movable contact 40 to the contact carrier 44. Such additional manufacturing operations increase the cost of the switch.

The contact element 50 of the prior art movable contact shown in FIGS. 2 and 3 is riveted through a hole in the distal end of the movable contact 40. The height of the back portion of the rivet, i.e. the portion which is deformed over in the riveting process, also determined the amount of overtravel of contact carrier 44 after the movable contact element 50 engaged the respective stationary contact. The height dimension of the riveted portion of contact element 50 was difficult to maintain consistent so as to provide the desired overtravel and simultaneous contact closure or separation. Moreover, riveting the contact element represents yet another additional step and cost in the manufacturing process.

SUMMARY OF THE INVENTION

This invention provides an electric switch having an improved attachment structure for attaching the movable contact to the movable insulating contact carrier. The improved structure provides self-alignment pivoting of the contact with respect to the insulating contact carrier and attachment of the contact to the carrier without stressing the contact at the point of attachment. The movable contact has structural elements formed in manufacture of the contact which may be held to closely toleranced dimensions to provide more precise over-travel dimension control. The contact element is welded to the movable contact during manufacture of the movable contact, providing an improved electrical joint with the movable contact as well as eliminating a manufacturing step over the prior art device. The invention and its advantages will become more clear when reading the following specification and claims in conjunction with the accompanying drawings.

DETAILED DESCRIPTION OF THE INVENTION

Figure 1:
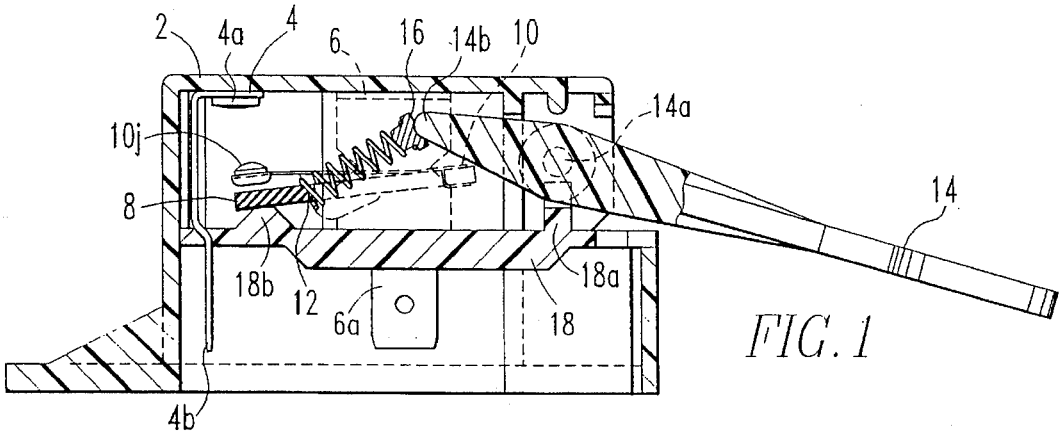
FIG. 1 is a cross sectional view of an electric sump pump switch having a movable contact mechanism constructed in accordance with this invention.
Figure 2:
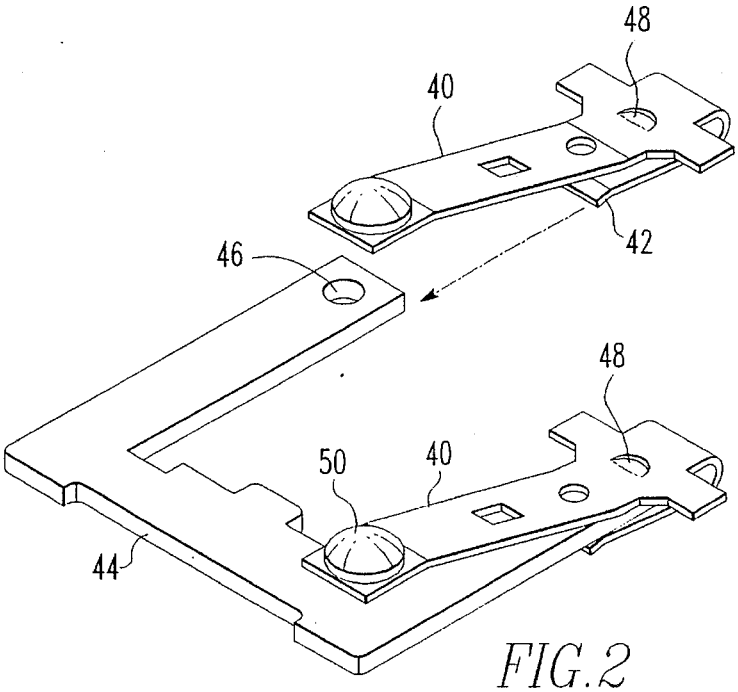
FIG. 2 PRIOR ART
FIG. 2 is an exploded three-dimensional view of a prior art embodiment of a movable contact assembly usable in the switch of FIG. 1.
Figure 3:
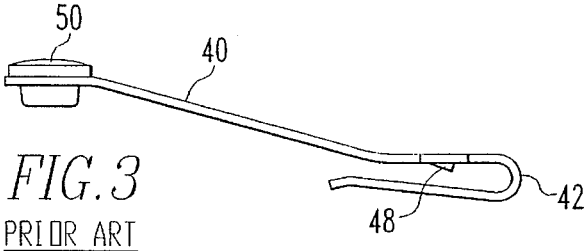
FIG. 3 PRIOR ART
FIG. 3 is a side elevational view of the prior art movable contact of FIG. 2.

An electric sump pump switch constructed in accordance with this invention is shown in cross section in FIG. 1.

Figure 4:
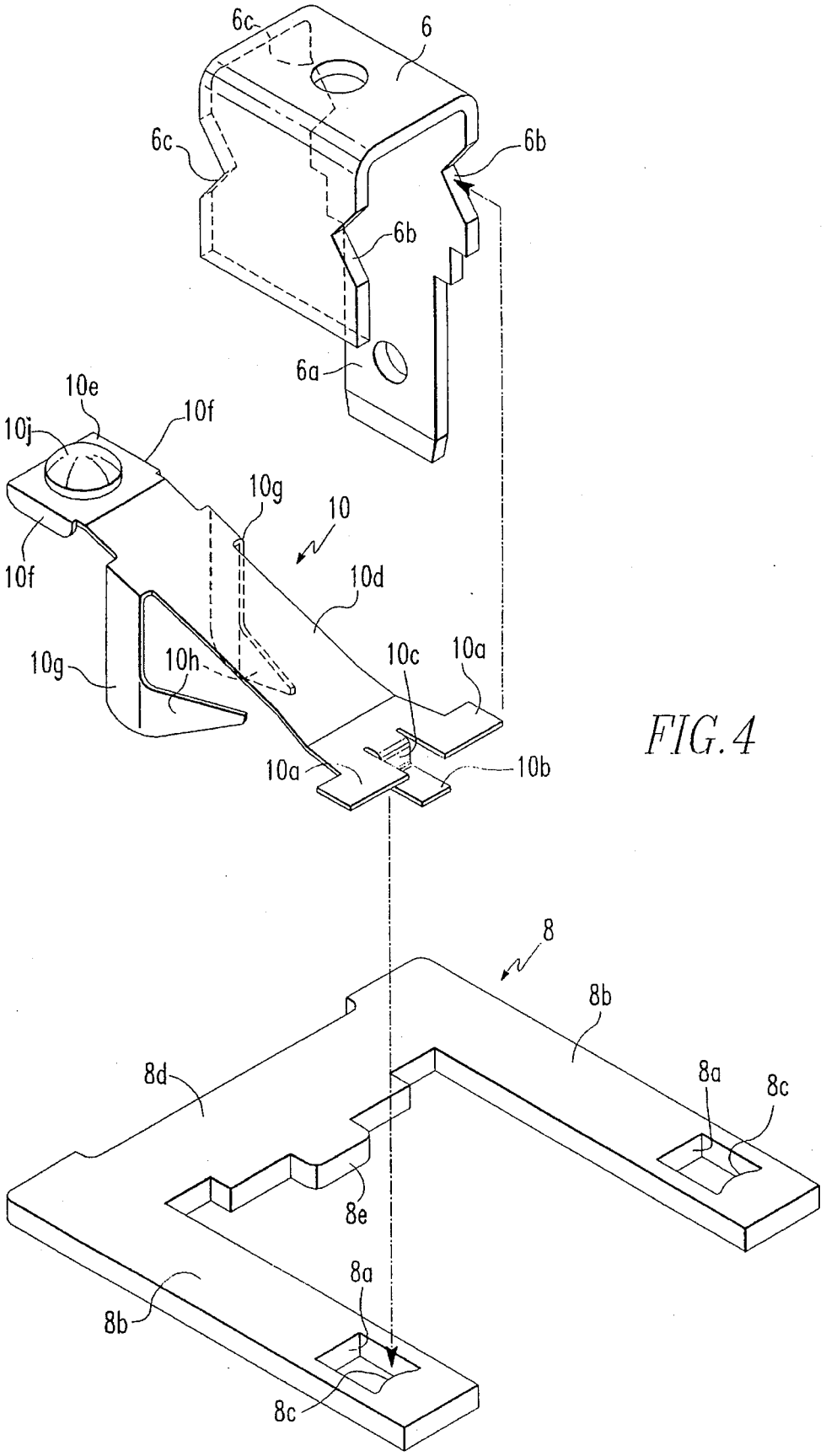
FIG. 4 is an exploded three-dimensional view of an improved movable contact and insulating contact carrier constructed in accordance with this invention.

Reference may be had to U.S. Pat. No. 4,196,325 incorporated herein for additional details of the overall switch construction. The switch comprises a hollow molded insulating housing 2 open to the bottom as oriented in the drawing. A pair of inverted L-shaped stationary contact terminals 4 (only one shown) having contact elements 4*a* secured to the short leg thereof are mounted in the housing within appropriate slots molded in the housing. A terminal tab 4*b* extends to the lower portion of the switch housing 2. A pair of inverted U-shaped terminals 6 (only one shown) are mounted in spaced pockets within housing 2. The details of this terminal are best seen in FIG. 4. Terminal 6 comprises a depending tab 6*a* which extends into the lower portion of the housing 2. The front and rear edges of the U-shaped terminal are provided with transversely aligned V-shaped notches 6*b* and 6*c*, respectively, to provide spaced bearing points in which the fulcrums of a movable contact assembly may pivot as will be described hereinafter. Terminals 6 are identical and are reversed with respect to each other when assembled into housing 2. Although terminals 4 and 6 are disclosed as having depending terminal tabs 4*b* and 6*a*, respectively, the tabs could alternatively be omitted and wire leads could be attached to the terminals to extend through the bottom of the housing. A movable contact assembly comprising a U-shaped stamped sheet insulation contact carrier 8 and a pair of movable contacts 10 is pivotally mounted within the housing 2. The details of these members are also best seen in FIG. 4. Apertures 8*a* are formed near the distal end of outer legs 8*b* of contact carrier 8. One edge of the apertures 8*a* comprises a convex surface 8*c* directed toward the base leg 8*d* of the insulating contact carrier. The latter also has an outwardly directed tab 8*e* formed at the center of the base leg 8*d* to serve as a seat for a compression spring 12 to be more fully described hereinafter.

Movable contact members 10 (only one shown in FIG. 4) are made from a thin sheet metal such as beryllium copper alloy or other metal or alloy having good electrical conductivity and resiliency. One end of the contact has a pair of oppositely directed tabs 10*a* disposed in a primary plane of the contact which is also the primary plane of the contact carrier 8. Tabs 10*a* are separated by an offset tab 10*b* which is sheared from the primary plane of the contact 10 and offset downwardly and outwardly as viewed in FIG. 4 to extend parallel to the primary plane of the contact. A right-angle transition portion 10*c* joins the primary plane of contact 10 with offset tab 10*b*. A beam portion 10*d* of contact 10 extends obliquely from the end of the contact constituting the primary plane. The distal end 10*e* of beam 10*d* is bent obliquely to be substantially parallel to the primary plane of the contact. Distal end 10*e* has a pair of ears 10*f* bent downwardly along the lateral edges thereof. A pair of downwardly bent arms 10*g* also extend from lateral edges of beam 10*d* near the distal end 10*e*, the arms terminating in inwardly bent hook portions 10*h*. The lower edges of hook portions 10*h* are angled upward toward the distal tip of the arm to present cam surfaces on the hook portions for a purpose to be described later. A contact element 10*j* is affixed to the upper surface of distal end 10*e* such as by welding or the like during one of the forming or blanking steps of the contact member, therefore obviating a separate additional step.

Figure 5:
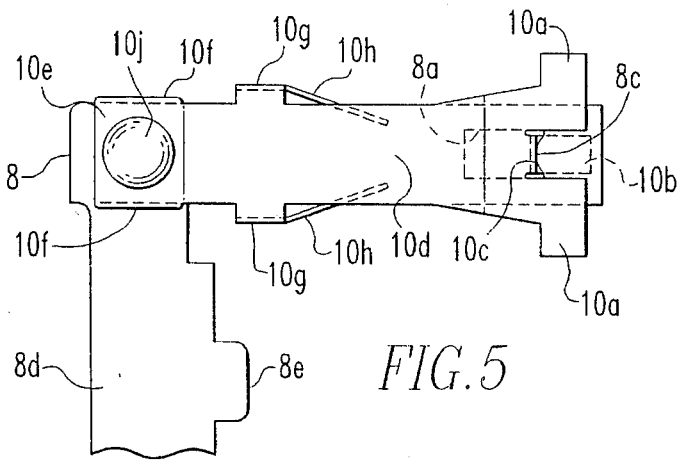
FIG. 5 is a partial plan view of the improved movable contact and insulating contact carrier of this invention.

The movable contacts 10 are attached to movable insulating contact carrier 8 by tipping the contacts angularly, inserting the offset tab 10*b* through the respective aperture 8*a*, and then rocking the distal end of the contact 10 downwardly such that the angled cam surface of hook portions 10*h* engage lateral edges of the respective outer leg 8*b* of the contact carrier. Pressure on contact 10 forcing it onto the carrier causes the hook portions 10*h* to spread apart over the lateral edges of leg 8*b* until the hook portions 10*h* clear the opposite side of the leg 8*b*, whereupon they flexibly converge under the leg 8*b*. Offset tab 10*b* extends along the opposite side of leg 8*b* to anchor that end of the contact to the carrier. The assembled movable contact and one-half of the insulating contact carrier are shown in plan view in FIG. 5. As may be seen, the flat surface of transition portion 10*c*, which is substantially perpendicular to the primary plane of the movable contact, rests against the convex surface 8*c* of carrier 8 to permit pivotal movement of the movable contact in the primary plane of the movable contact 10 and the flat U-shaped insulating movable contact carrier 8. With movable contacts 10 assembled to both legs 8*b* of carrier 8, the assembly is positioned in the switch housing such that the edges of tabs 10*a* which face in the direction of the distal end of the movable contacts are disposed within the V-shaped notches 6*b* and 6*c* of the respective terminals 6 to provide a pivot fulcrum for the movable contact assembly. The ability of the movable contact to pivot in its primary plane on the movable contact carrier 8 permits the movable contacts to be self-aligning within the respective V-shaped notches, accommodating any misalignment of the notches in manufacture or assembly of the terminals.

Referring again to FIG. 1, an operating lever 14 is pivotally mounted in the housing 2 by a pair of oppositely directed trunions 14*a* which are received in respective slots (not shown) in the housing. An interior end of the operating lever 14 has a substantially semispherical tip 14*b* which mates within a cooperating substantially semispherical recess in a spring cap 16 positioned within an open end of helical compression spring 12. The opposite end of helical compression spring 12 is positioned over the seat 8*e* of movable insulating contact carrier 8. In a well known manner, spring 12 is compressed between the end 14*b* of lever 14 and the base leg 8*d* of contact carrier 8 to provide a snap action overcenter mechanism for the switch. The compressive force generated by spring 12 pulls the edges of tabs 10*a* firmly within the V-shaped notches 6*b* and 6*c* and pulls the convex surfaces 8*c* firmly against flat transition surfaces 10*c* to hold the entire assembly together. An insulating cover 18 is disposed over the switch elements within the housing 2 and secured thereto by screws or similar fasteners, not shown. Cover 18 is provided with appropriate slots through which the tab portions 4*b* and 6*a* of the terminals 4 and 6, respectively, extend. Cover 18 is provided with an upstanding projection 18*a* at one end which cooperates with the slots in housing 2 to abut the trunions 14*a* of lever 14 to complete a pivot for the lever. The upper surface of cover 18 is also provided with an upstanding conical projection 18*b* to serve as a fixed stop for the base leg 8*d* of movable insulating contact carrier 8.

Figure 7:
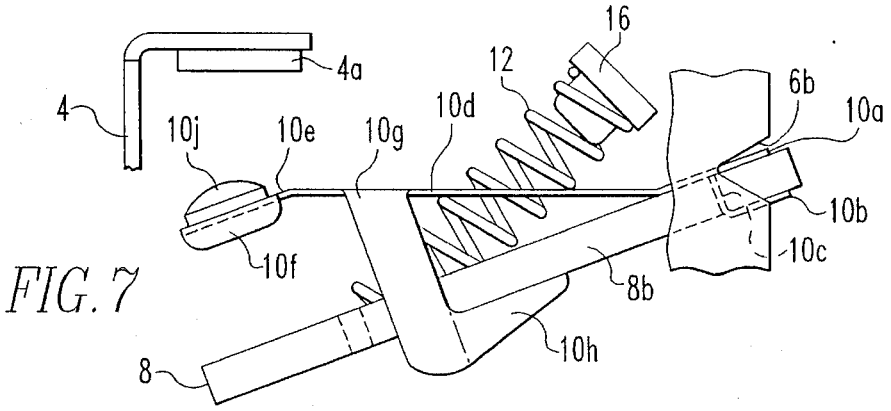
FIG. 7 is a fragmentary view similar to FIG. 6 showing the improved movable contact assembly in a switch open position.

The particular construction of the movable contact 10 and the aperture 8*a* and convex surface 8*c* thereof of the movable contact carrier eliminates the problems that were present in the previous designs. The offset tab 10*b* provides a solid anchor point for the end of the movable contact without a requirement for close tolerance provisions. The ears 10*f* may be bent to a specific dimension whose tolerances can be closely held during manufacture so as to provide a consistent rearward dimension of the movable contact for determining the overtravel. Hook portions 10*h* of rearwardly extending arm 10*g* cooperate with the rear edges of ears 10*f* to further define the overtravel dimension. With the opposite side of the leg 8*b* against the upper surfaces of the hooks 10*h* as seen in FIG. 7, the distance between the contact side of leg 8*b* and the back edge of the ears 10*f* is the permissible overtravel of the movable contact carrier after the contact tip element 10*j* engages the stationary contact element 4*a*. The more nearly identical the overtravel dimension is held at both movable contacts, the more nearly simultaneously the contacts open and close on the stationary contacts to provide improved operation of the double pole sump pump switch.

Figure 6:
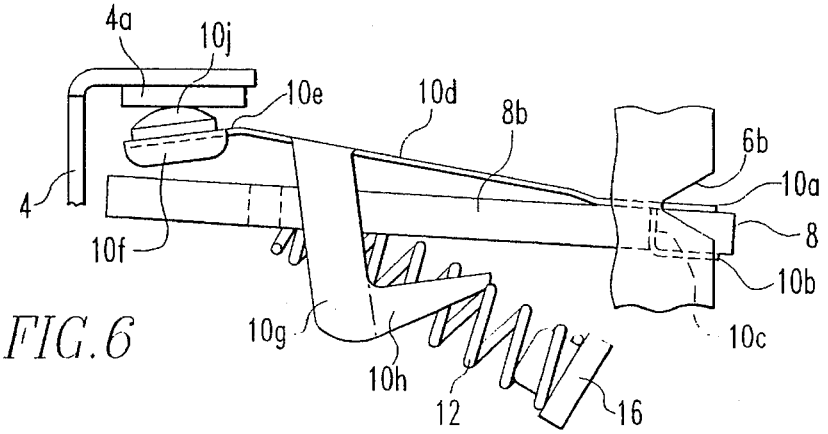
FIG. 6 is a fragmentary view showing the movable contact assembly constructed in accordance with this invention in a closed switch operating position.

FIG. 6 shows the contact assembly in the switch ON position wherein movable contact element 10*j* abuts stationary contact element 4*a*, deflecting the flexible beam 10*d*. The force of overcenter spring 12 continues to move the movable insulating contact carrier 8 in the contact closing direction until the carrier abuts the ears 10*f* of the movable contact assembly. When the operating lever 14 is moved in the opposite direction, overcenter spring 12 drives the movable contact carrier 8 away from the stationary contacts, hook portions 10*h* of arms 10*g* engage the opposite side of contact carrier 8 and substantially simultaneously pull the movable contact members 10 in the contact opening direction. An added benefit of hook portions 10*h* is that they will break any welds or sticking of the contacts that may occur.

The foregoing has described an improved movable contact assembly for an electric switch, particularly an electric sump pump switch, wherein the components may be manufactured and assembled with minimal operations and cost, while maintaining preferred dimensional stability of the assembly. While the invention has been shown and described in conjunction with a preferred embodiment, it is to be understood that it is susceptible of various modification without departing from the scope of the appended claims.

We claim:

1. In an electric switch comprising an insulating housing;

stationary contact means mounted in said housing;

electrically conductive terminal means mounted in said housing, said terminal means comprising two spaced bearing points;

a movable insulating member disposed in said housing;

switch operating means mounted to said housing for movement between extreme positions, said operating means being connected to said movable insulating member;

movable contact means disposed between said spaced bearing points and having fulcrum means extending in opposite directions in a primary plane of said movable contact means, said fulcrum means engaging said spaced bearing points for pivotally supporting said movable contact means on said terminal means, said movable contact means further having a flexible beam extending obliquely out of said primary plane, said beam having a movable contact element on a distal end thereof; and attachment means for attaching said movable contact means to one side of said movable insulating member for substantially positive rotatable movement with said insulating member about said engaged fulcrum means and bearing points and for pivotal movement in said primary plane relative to said insulating member, said obliquely extending flexible beam overlying said insulating member and being spaced therefrom;

the improvement wherein said attachment means comprises:

convex surface means on said insulating member;

offset tab means on said movable contact means offset from said primary plane and extending along a side of said insulating member opposite said one side for holding said movable contact means to said insulating member; and transition means between said movable contact means primary plane and said offset tab means providing substantially flat surface means normal to said primary plane abutting said convex surface means for permitting said pivotal movement of said movable contact means in said primary plane relative to said insulating member.

2. The electric switch of claim 1 wherein said flat surface means of said transition means is disposed between said fulcrum means and aligned with said fulcrum means.

3. The electric switch of claim 1 wherein said distal end of said flexible beam comprises an ear extending toward said movable insulating member said one side, said ear providing a positive stop for said insulating member when said movable contact element is in engagement with said stationary contact means.

4. The electric switch of claim 1 wherein said distal end of said flexible beam comprises a pair of laterally disposed ears bent from said beam and extending toward said movable insulating member said one side, said ear providing a positive stop for said insulating member when said movable contact element is in engagement with said stationary contact means.

5. The electric switch of claim 1 wherein said flexible beam comprises means extending therefrom engaging said movable insulating member for limiting movement of said flexible beam away from said insulating member.

6. The electric switch of claim 5 wherein said means extending from said flexible beam comprises a hook engaging said opposite side of said insulating member.

7. The electric switch of claim 5 wherein said means extending from said flexible beam comprises a pair of laterally disposed arms bent from said beam, said arms having respectively converging hook portions at distal ends thereof, said arms extending alongside lateral edges of said insulating member and said hook portions converging over said opposite side.

8. The electric switch of claim 7 wherein said arms and said hook portions are flexible and said hook portions comprise cam surfaces for deflecting said hook portions over lateral edges of said insulating member when said movable contact means is attached to said one side of said insulating member and said flexible beam is pressed through said insulating member.

9. The electric switch of claim 7 wherein said distal end of said flexible beam comprises a pair of laterally disposed ears bent from said beam and extending toward said movable insulating member said one said, said ears providing a positive stop for said insulating member when said movable contact element is in engagement with said stationary contact means, adjacent edges of said ears and said hook portions providing a readily controllable dimension therebetween for setting overtravel of said movable insulating member.

10. An electric switch comprising:

an insulating housing;

a pair of spaced stationary contacts mounted in said housing;

a pair of electrically conductive terminals mounted in said housing, said terminals each comprising two spaced bearing points;

a U-shaped movable insulating member disposed in said housing;

a switch operating member movably mounted in said housing movable between a pair of extreme positions, said operating member being connected to said insulating member by a compression spring;

a pair of movable contacts, each disposed between said spaced bearing points of a respective said conductive terminal, each movable contact having a pair of tabs extending in opposite directions in a primary plane of said movable contact, an edge of each respective tab engaging a respective one of said bearing points to provide a fulcrum for pivotally supporting said movable contact to a respective conductive terminal, said movable contacts each having a flexible beam extending obliquely out of said primary plane and having a movable contact element on a distal end thereof overlying a respective said stationary contact; and attachment means for attaching said movable contacts to said movable insulating member comprising:

a convex surface at a distal end of each leg of said U-shaped insulating member, said convex surface facing a closed end of said U-shaped insulating member;

an offset tab on each movable contact offset from said primary plane and extending in a direction substantially opposite said beam; and a transition portion connecting said primary plane and said offset tab, said transition portion being at generally a right angle to said primary plane providing a substantially flat surface;

each said movable contact being attached to a respective said leg of said U-shaped insulating member, said fulcrum tabs disposed on one side of said insulating member, said offset tab engaging a side of said insulating member opposite said one side, and said transition portion abutting a respective convex surface, said movable contacts being substantially positively rotatable with said insulating member about said engaged fulcrums and bearing points in response to overcenter movement provided by said spring and said operator, and being pivotally movable relative to said insulating member in said primary plane of said movable contact about said convex surface.

11. The electric switch of claim 10 wherein respective said edges of said oppositely extending tabs and said flat surface of said transition portion are disposed in a common transverse plane of said movable contact.

12. The electric switch of claim 10 wherein an aperture is provided in said distal end of each said leg of said U-shaped insulating member, said convex surface comprising one edge of a respective said aperture, and said offset tab extends through said aperture to said opposite side of said insulating member.

13. The electric switch of claim 10 wherein said distal end of said flexible beam of each said movable contact comprises an ear extending toward said movable insulating member leg, said ear providing a positive stop for said insulating member when said movable contact element is in engagement with said respective stationary contact.

14. The electric switch of claim 10 wherein said distal end of said flexible beam of each said movable contact comprises a pair of laterally disposed ears bent from said beam and extending toward said movable insulating member, said ears providing a positive stop for said insulating member when said movable contact element is in engagement with said respective stationary contact.

15. The electric switch of claim 10 wherein said flexible beam comprises means extending therefrom engaging a respective leg of said movable insulating member for limiting separating movement of said flexible beam from said insulating member.

16. The electric switch of claim 15 wherein said means extending from said flexible beam comprises a hook engaging said opposite side of said insulating member.

17. The electric switch of claim 15 wherein said means extending from said flexible beam comprises a pair of laterally disposed arms bent from said beam, said arms having respectively converging hook portions at distal ends thereof, said arms extending alongside lateral edges of a respective said leg of said insulating member and said hook portions converging over said opposite side of said insulating member leg.

18. The electric switch of claim 17 wherein said arms and said hook portions are flexible and said hook portions comprise cam surfaces engaging lateral edges of respective said insulating member legs whereby pressure on said flexible beam forcing said movable contact member to said leg causes said hook portions and said arms to spread around said leg and re-converge on said opposite side of said leg.

19. The electric switch of claim 17 wherein said distal end of said flexible beam comprises a pair of laterally disposed ears bent from said beam and extending toward said movable insulating member, said ears providing a positive stop for said insulating member when said movable contact element is in engagement with said stationary contact, adjacent edges of said ears and said hook portions providing a controlled dimension therebetween for setting overtravel of said movable insulating means.

* * * * *